US010830170B2

(12) United States Patent
Zhang et al.

(10) Patent No.: US 10,830,170 B2
(45) Date of Patent: Nov. 10, 2020

(54) COMBINED ANALOG-DIGITAL GASOLINE ENGINE IGNITION METHOD AND DEVICE

(71) Applicant: ZHEJIANG FENGLONG ELECTRICAL MACHINERY CO., LTD, Zhejiang (CN)

(72) Inventors: Wangfu Zhang, Zhejiang (CN); Bin Zhang, Zhejiang (CN); Jiang Li, Zhejiang (CN); Meijun Zheng, Zhejiang (CN)

(73) Assignee: ZHEJIANG FENGLONG ELECTRICAL MACHINERY CO., LTD., Shaoxing (CN)

( * ) Notice: Subject to any disclaimer, the term of this patent is extended or adjusted under 35 U.S.C. 154(b) by 63 days.

(21) Appl. No.: 16/327,767

(22) PCT Filed: Jan. 11, 2017

(86) PCT No.: PCT/CN2017/070931
§ 371 (c)(1),
(2) Date: Feb. 22, 2019

(87) PCT Pub. No.: WO2018/040479
PCT Pub. Date: Mar. 8, 2018

(65) Prior Publication Data

US 2019/0203657 A1 Jul. 4, 2019

(30) Foreign Application Priority Data

Aug. 29, 2016 (CN) ..... 2016 1 0743031

(51) Int. Cl.
*F02D 41/26* (2006.01)
*F02P 3/08* (2006.01)
(Continued)

(52) U.S. Cl.
CPC ..... *F02D 41/266* (2013.01); *F02D 28/00* (2013.01); *F02D 39/04* (2013.01); *F02D 41/2412* (2013.01); *F02P 3/08* (2013.01); *F02P 3/0846* (2013.01); *F02D 2250/21* (2013.01); *F02D 2250/28* (2013.01)

(58) Field of Classification Search
CPC ..... F02D 41/266; F02P 3/08; F02P 3/0846; F02P 3/09; F02P 5/1558; F02P 15/008
See application file for complete search history.

(56) References Cited

U.S. PATENT DOCUMENTS 3,923,021 A * 12/1975 Stark ..... F02P 5/15 123/406.55
4,531,190 A * 7/1985 Drews ..... F02P 15/008 123/479
(Continued)

*Primary Examiner* — Sizo B Vilakazi
*Assistant Examiner* — Anthony L Bacon
(74) *Attorney, Agent, or Firm* — Thomas|Horstemeyer LLP

(57) ABSTRACT

Disclosed is a complementary analog and digital method for controlling ignition of a gasoline engine. First, analog ignition is performed by means of an analog trigger circuit. After power has been steadily supplied to a microcontroller, the microcontroller disconnects the analog trigger circuit, starts to collect a digital trigger reference signal and turn on a digital trigger circuit, and switches to a digital signal to trigger ignition. Also disclosed is a complementary analog and digital system for controlling ignition of a gasoline engine.

5 Claims, 5 Drawing Sheets

(51) Int. Cl.

| | |
|---|---|
| ***F02D 28/00*** | (2006.01) |
| ***F02D 39/04*** | (2006.01) |
| ***F02D 41/24*** | (2006.01) |

(56) References Cited

U.S. PATENT DOCUMENTS

| | | | | |
|---|---|---|---|---|
| 2008/0178841 | A1* | 7/2008 | Andersson | F02P 3/0815<br>123/406.57 |
| 2020/0032699 | A1* | 1/2020 | Andersson | F02B 63/02 |

* cited by examiner

COMBINED ANALOG-DIGITAL GASOLINE ENGINE IGNITION METHOD AND DEVICE

CROSS REFERENCE TO RELATED APPLICATIONS

This application is a 35 U.S.C. § 371 national phase application of PCT/CN2017/070931, filed on Jan. 11, 2017, which application claims priority from Chinese Patent Application No. 201610743031.5, filed on Aug. 29, 2016. The entire application including all tables, diagrams and claims is incorporated hereby as reference of the present invention.

FIELD OF THE INVENTION

The present invention relates to a gasoline engine ignition method with analog and digital complementary control and device thereof, which is applied to a small internal combustion gasoline engine, such as a lawn mower, a brush cutter, a hedge trimmer, a chain saw in the field of gardening tools.

BACKGROUND OF THE INVENTION

The traditional digital igniters for small gasoline engines adopt MCU as a core control unit to adjust the corresponding ignition angle according to the speed of the gasoline engine. However, as it takes a period of time for the MCU to work normally and stably during the startup process, a phenomenon that the gasoline engine is not easy to start may occur; and if the startup is not controlled appropriately, it is easy to cause false triggering.

SUMMARY OF THE INVENTION

In order to overcome the drawbacks of the prior art, the present invention provides a fast and stable gasoline engine ignition method with analog and digital complementary control and device thereof.

In order to achieve the above object, the present invention adopts the following technical solutions:

A gasoline engine ignition method with analog and digital complementary control, comprising: performing an analog ignition by an analog trigger circuit, and starting to acquire digital trigger reference signals and connecting to a digital trigger circuit when the SCM power supply is stabilized and the SCM cuts off the analog trigger circuit, and then switching to digital signals to trigger ignition.

Further, continuing N times of analog trigger ignitions when the SCM power supply is stabilized, and recording the accumulated number of running turns of the engine and the N-th running cycle of engine Tn; cutting off the analog trigger circuit when the number of running turns is equal to the preset number of turns N, and starting to acquire digital trigger reference signals and connecting to the digital trigger circuit after the time of Tn/M.

The present invention further discloses an ignition system of gasoline engine with analog and digital complementary control, comprising:

- a SCM;
- a capacitor charging circuit for charging a charging capacitor, comprising a charging coil L1, a diode D1, and a charging capacitor C1;
- a thyristor Q1, used to control the charging capacitor C1 for charging and discharging;

- a digital trigger reference signal processing circuit, connected to the SCM, for processing a voltage signal generated by the charging coil L1 to form a digital trigger reference signal;
- an analog trigger circuit, connected to the thyristor Q1, for controlling a discharge timing of the charging capacitor C1;
- a digital trigger circuit, connected to the SCM and the thyristor Q1, for controlling the discharge timing of the charging capacitor C1;

The present invention has set up an analog trigger circuit and a digital trigger circuit. At the beginning of the startup, the ignition mode is triggered by analog signals, to achieve quick ignition. It can be started by just pulling one turn (trigger ignition). When SCM power supply is stabilized, it is switched to digital signal trigger ignition mode. After converted to digital trigger, a more accurate ignition angle can be obtained, to ensure stable operation of engine.

Further, the ignition system of gasoline engine with analog and digital complementary control further comprising:

- an ignition mode switching circuit, connected to the SCM and the analog trigger circuit, for cutting off the analog trigger circuit;
- a monitoring module, disposed in the SCM and connected to the analog trigger circuit, for monitoring the analog ignition signal of the analog trigger circuit and recording the engine running cycle value Tn at the last trigger when the SCM power supply is stabilized;
- a signal acquisition module, disposed in the SCM and connected to the digital trigger reference signal processing circuit, for determining when to acquire the digital trigger reference signal according to the engine running cycle value Tn recorded by the monitoring module.

The analog signal trigger ignition mode is converted to the digital signal trigger ignition mode quickly and stably through the ignition mode switching circuit and the monitoring module. The monitoring module monitors the analog ignition signal of the analog trigger circuit, and records the number of engine running cycles and the running cycle Tn by a timer; the running cycle Tn is the engine running cycle value under the last analog trigger ignition mode. With the running cycle Tn, the signal acquisition module can accurately judge when to acquire the digital trigger reference signals. Compared to the conventional digital trigger circuit that needs to acquire signals after the engine rotates several turns, the present invention can acquire signals more quickly and accurately, and start the engine more quickly, to avoid false triggering effectively.

Further, an isolating circuit is provided between the analog trigger circuit and the digital trigger circuit for isolating the analog trigger ignition signal from the digital trigger ignition signal. The isolating circuit is used to prevent damage to SCM interface by excessive voltage on the analog trigger circuit.

Still further, the ignition system of gasoline engine with analog and digital complementary control further comprises a flameout circuit, connected to the SCM and the analog trigger circuit, for cutting off the analog trigger circuit and the digital trigger circuit. The flameout circuit can simultaneously control the analog trigger circuit and the digital trigger circuit through a single switch.

Further, the ignition system of gasoline engine with analog and digital complementary control further comprises a power supply circuit connected to the SCM for receiving a first AC waveform P1 and a second AC waveform P2 generated by the charging coil and providing power source for SCM.

In summary, the present invention has the following advantages: the ignition mode is triggered by analog signals at the beginning of the startup, to achieve quick ignition. When SCM power supply is stabilized, it is switched to digital signal trigger ignition mode. After converted to digital trigger, a more accurate ignition angle can be obtained, to ensure stable operation of the engine.

DETAILED DESCRIPTION

In order to better understand the technical solutions herein, the technical solutions in the embodiments of the present invention are clearly and completely described with reference to the accompanying drawings herein.

Figure 5:
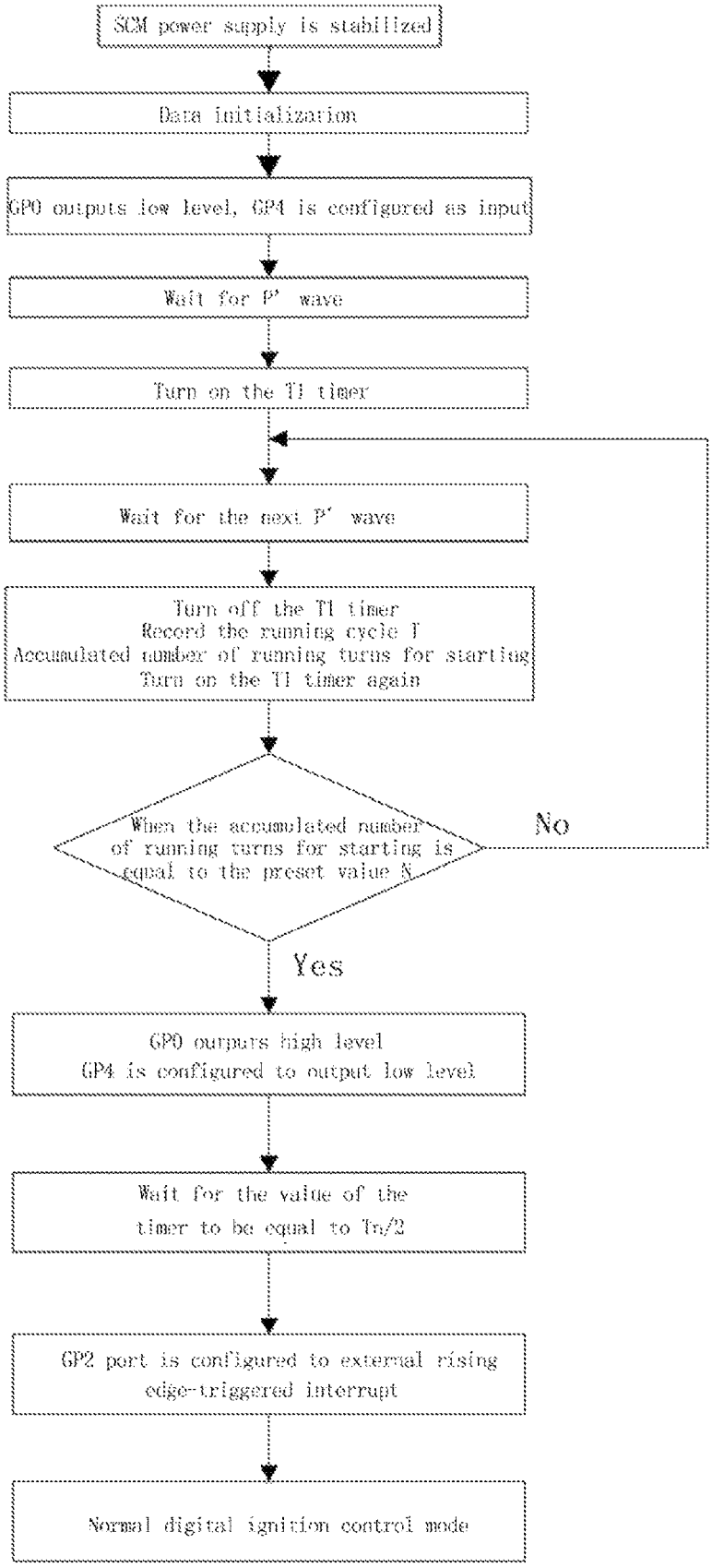
FIG. 5 is a flowchart showing switching of an analog trigger ignition and a digital trigger ignition control according to an embodiment of the present invention.

As shown in FIG. 5, a gasoline engine ignition method with analog and digital complementary control, comprising: performing an analog ignition by an analog trigger circuit, and starting to acquire digital trigger reference signals and connecting to a digital trigger circuit when the SCM power supply is stabilized and the SCM cuts off the analog trigger circuit, and then switching to digital signals to trigger ignition. At the beginning of the startup, the ignition mode is triggered by analog signals, to achieve quick ignition. It can be started by just pulling one turn to trigger ignition. When SCM power supply is stabilized, it is switched to digital signal trigger ignition mode. After converted to digital trigger, a more accurate spark advance angle can be obtained, to ensure stable operation of the engine.

Specifically, in the process of switching from analog ignition mode to digital ignition mode, we will continue to perform N times of analog trigger ignition when the SCM power supply is stabilized, and record the accumulated number of running turns of the engine and the N-th running cycle of engine Tn in order to accurately and quickly determine when to acquire digital trigger signals; when the number of running turns is equal to the preset number of turns N, the analog trigger circuit is cut off, and timing is started. When the timer reaches the value of Tn/M (M may be a natural number greater than 1, preferably M=2 in the present embodiment), the digital trigger reference signals are started to be acquired and the digital trigger circuit is connected. This method can accurately acquire digital trigger reference signals for the first time, to effectively avoid false triggering.

Figure 1:
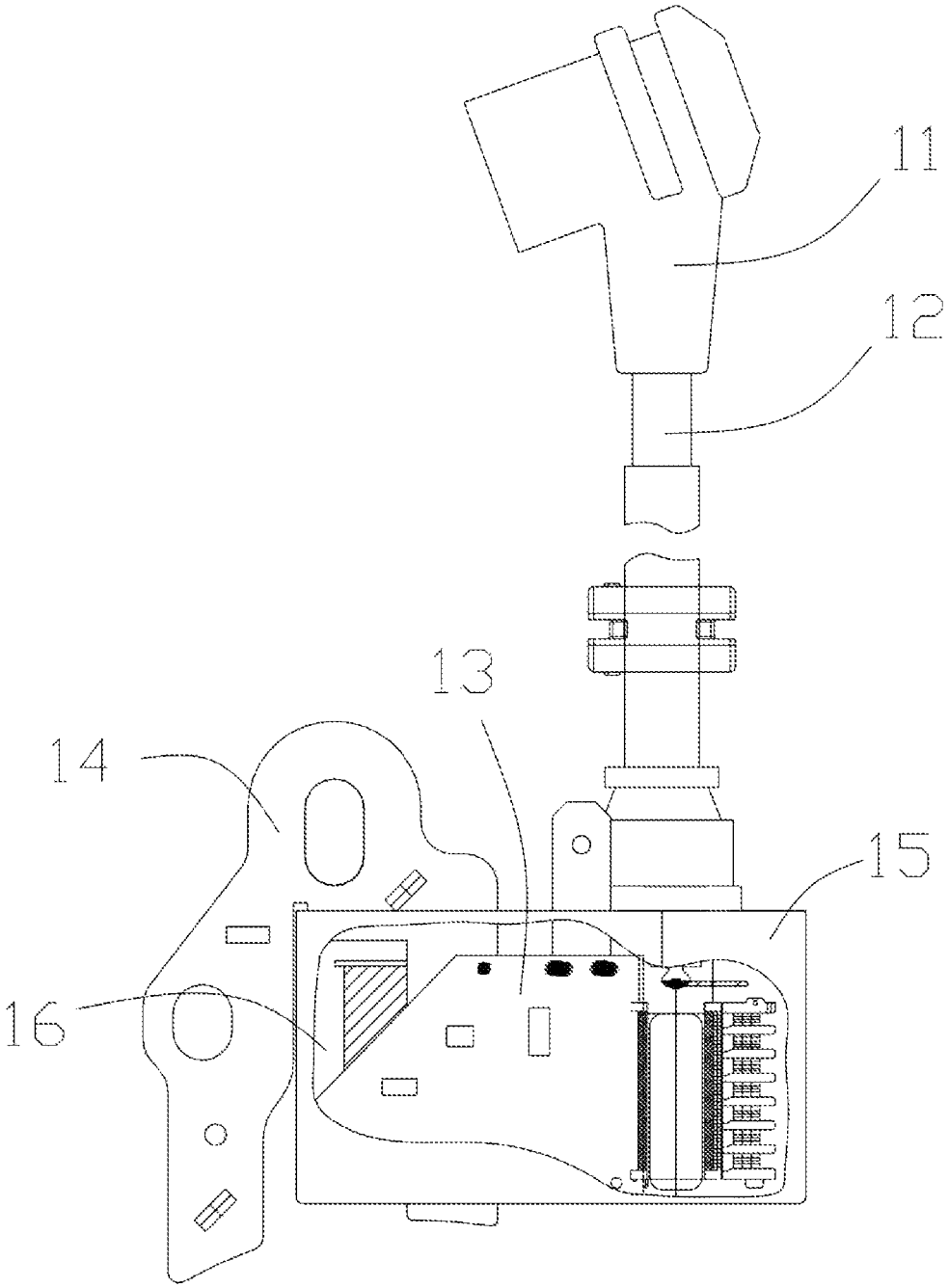
FIG. 1 is a schematic view of the mechanical structure of the present invention.
Figure 2:
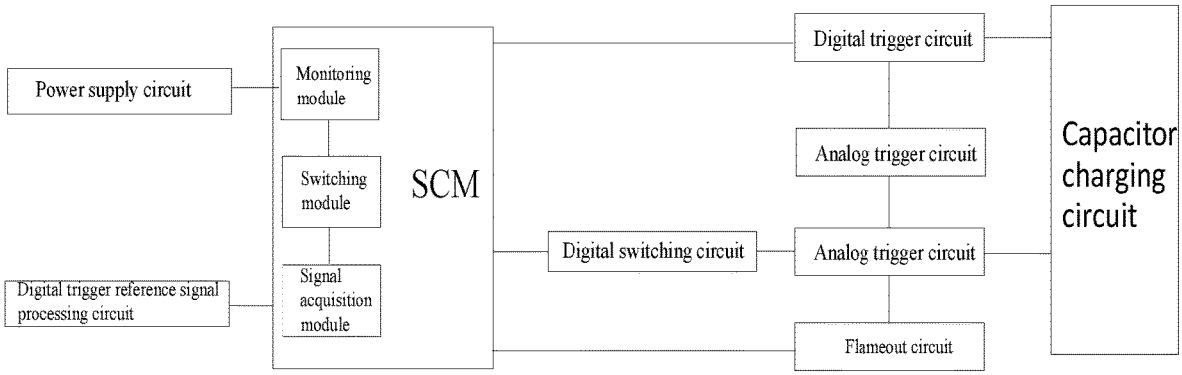
FIG. 2 is a schematic block diagram of the present invention.

As shown in FIG. 1 and FIG. 2, the present invention further provides an ignition system of gasoline engine with analog and digital complementary control. Its mechanical structure comprises a high voltage cap 11, a high voltage line 12, a control circuit 13, an iron core 14, an outer housing 15, and an epoxy material 16 filled in the gap of the outer casing;

The innovation of the present invention lies in the improvement of the control circuit 13. The improvement of the control circuit will be specifically described. Specially, the control circuit 13 comprises:

- a SCM, mainly used for data acquisition, calculation, processing and conversion. The data acquisition, calculation, processing and conversion are realized by the corresponding control procedures, and the SCM can be purchased from the markets. Specifically, the commercially available PIC12F series SCMs are chosen in this embodiment;
- a capacitor charging circuit, comprising a charging coil L1, a diode D1, and a charging capacitor C1; the capacitor charging circuit charges the charging capacitor C1 by receiving a third AC waveform P generated by the charging coil L1;
- a thyristor Q1, which is used to control the charging and discharging of the charging capacitor C1; when the thyristor is on, the charging capacitor C1 is discharged, and when the thyristor is off, the charging capacitor C1 is charged; a digital trigger reference signal processing circuit, connected to the SCM, used for processing the first AC voltage waveform P1 and the second AC voltage waveform P2 generated by the charging coil L1 to form digital trigger reference waveforms P1" and P2" respectively, for the signal acquisition by the SCM;
- an analog trigger circuit, that is connected to the control electrode of the thyristor Q1 and drives the turn-on or turn-off of the thyristor by an analog trigger ignition signal, and then controls the discharge timing of the charging capacitor C1;
- a digital trigger circuit, connected to the SCM and the control electrode of the thyristor Q1. After internal data processing of SCM, commands are sent to the digital trigger circuit and the digital trigger circuit outputs digital trigger ignition signals to the control electrode of the thyristor to drive the turn-on of the thyristor and thus control the discharge timing of the charging capacitor C1;
- an ignition mode switching circuit, connected to the SCM and the analog trigger circuit, for cutting off the analog trigger circuit. After internal data processing of SCM, commands are sent to the ignition mode switching circuit, and the digital switching circuit cuts off the analog trigger circuit, so that the analog trigger ignition signals cannot be transmitted to the control electrode of the thyristor. An isolating circuit is provided between the analog trigger circuit and the digital trigger circuit for isolating the analog trigger ignition signal from the digital trigger ignition signal, to prevent damage to the corresponding SCM interface by excessive voltage on the analog trigger circuit. Specifically, the isolating circuit comprises diodes D3, D4 in this embodiment;
- a monitoring module, disposed in the SCM and connected to the analog trigger circuit, for monitoring the analog ignition signal of the analog trigger circuit and recording the engine running cycle value Tn at the last trigger when the SCM power supply is stabilized;
- a signal acquisition module, disposed in the SCM and connected to the digital trigger reference signal processing circuit, for determining when to acquire the digital trigger reference signal according to the engine running cycle value Tn recorded by the monitoring module; the useful digital trigger reference waveform P1" is selected from digital trigger waveforms P1" and P2", and the current engine running cycle Tn+1 is recorded, and then the rotating speed is recorded according to the cycle, to get the corresponding ignition delay time from the table and perform digital trigger ignition.

a flameout circuit, connected to the SCM and the analog trigger circuit, for cutting off the analog trigger circuit and the digital trigger circuit. The flameout circuit can simultaneously control the analog trigger circuit and the digital trigger circuit through a single switch.

a power supply circuit, connected to the SCM for receiving a first AC waveform P1 and a second AC waveform P2 generated by the charging coil L1 and providing power source for SCM.

Figure 3:
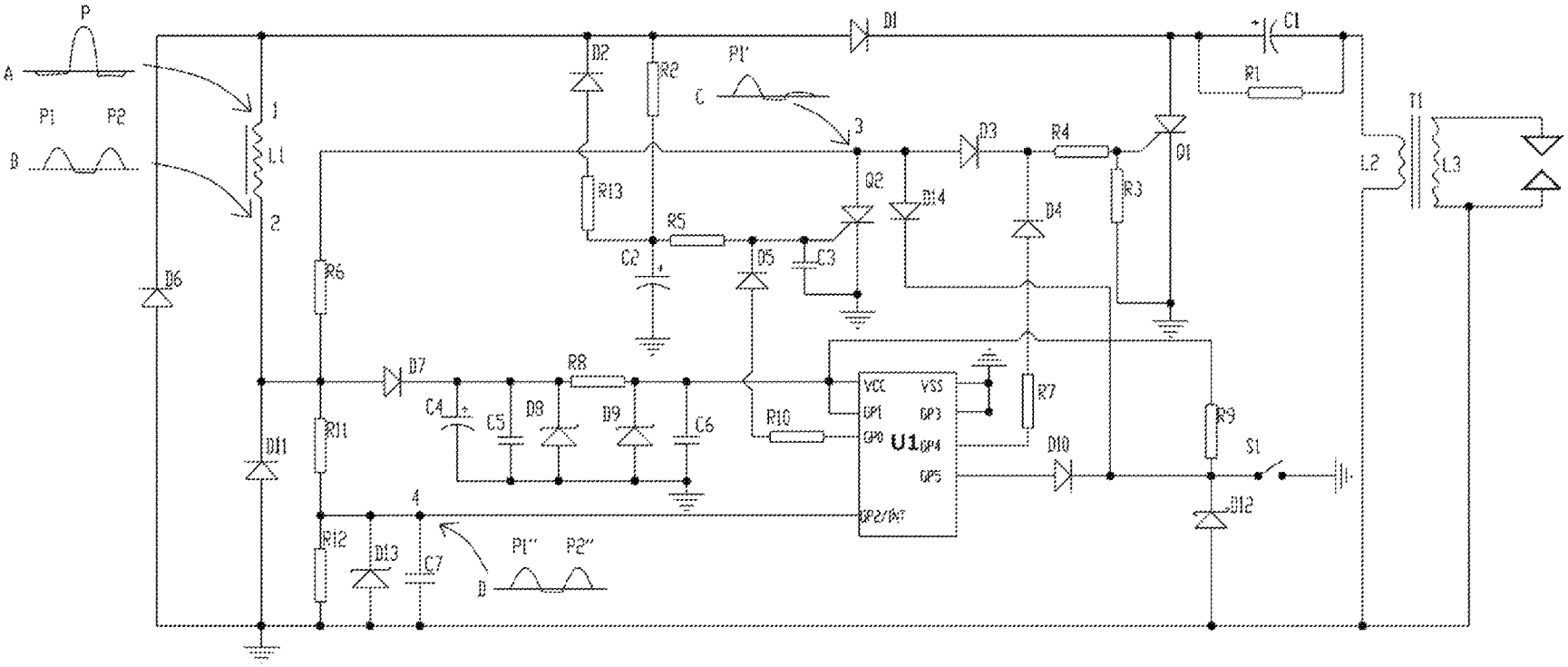
FIG. 3 is a circuit diagram of an embodiment of the present invention.
Figure 4:
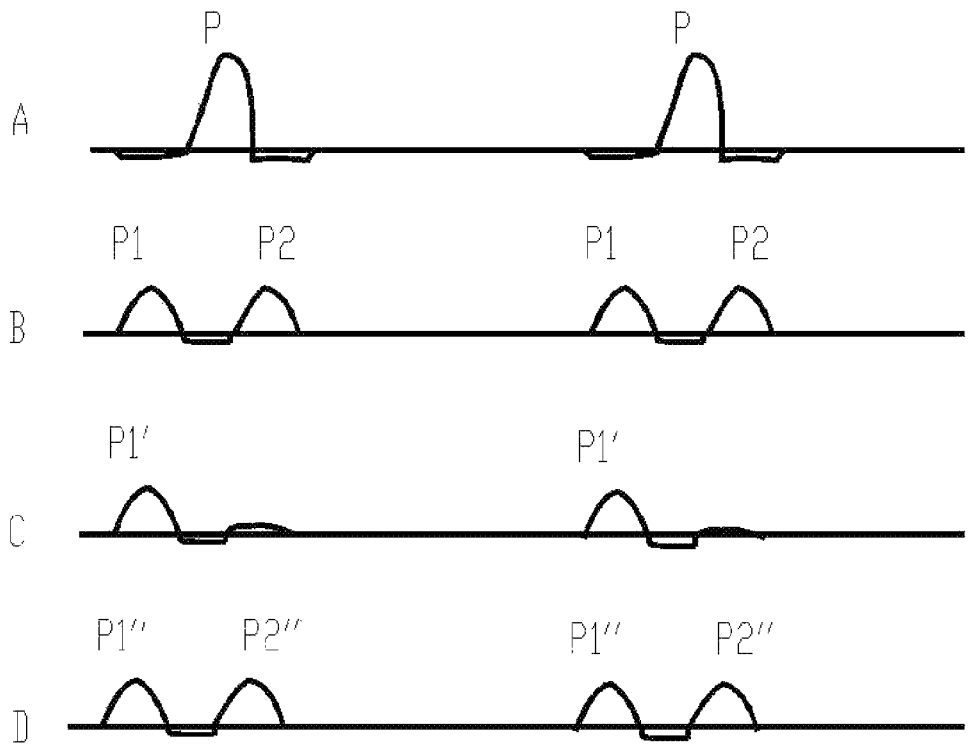
FIG. 4 is a schematic diagram of a trigger ignition waveform according to an embodiment of the present invention.

Specifically, as shown in FIG. 3, one of the circuit schematic diagrams of the present invention is provided in this embodiment;

The capacitor charging circuit comprises a charging coil L1, a diode D1, a charging capacitor C1, a discharge resistor R1, a step-up transformer T1, a diode D6, and a diode D11; the step-up transformer T1 comprises a primary coil L2 and a secondary coil L3; the end 1 of the charging coil L1 is connected to the anode of diode D1 and the cathode of diode D6 respectively; the anode of thyristor Q1 is connected to the cathode of diode D1 and the input end of charging capacitor C1 respectively; the discharge resistor R1 is connected in parallel with the charging capacitor C1, and the output end of the charging capacitor C1 is connected to the end 1 of the primary coil L2, and the end 2 of the primary coil L2 is connected to the end 2 of the secondary coil L3 and grounded, the end 1 of the secondary coil L3 is used to connect the spark plug; the anode of the diode D6, the cathode of the thyristor Q1 and the cathode of the diode D11 are all grounded; the anode of the diode D11 is connected to the end 2 of the charging coil L1.

The analog trigger circuit comprises resistors R6, R2, R13, R5, diodes D2, D3, and capacitors C2, C3, and a thyristor Q2.

One end of the resistor R6 is connected to the end 2 of the charging coil L1, and the other end of the resistor R6 is connected to the anode of the thyristor Q2 and the anode of the diode D3, respectively;

The control electrode of thyristor Q2 is grounded in parallel with the cathode capacitor C3, the cathode of diode D2 is connected to the end 1 of the charging coil L1, and the anode of diode D2 is connected to the anode of the capacitor C2 via the resistor R13, and the anode of the capacitor C2 is connected to the end 1 of the charging coil L1 via the resistor R2; the anode of capacitor C2 is connected to the control electrode of thyristor Q2 via the resistor R5; the cathode of capacitor C2 is grounded.

In FIG. 3, the digital control chip U1 is a PIC12F series SCM, including 8 pins, namely, GP0, GP1, GP2, GP3, GP4, GP5, VCC, and VSS. The power supply circuit of the SCM comprises a diode D7, capacitors C4, C5, C6, voltage regulator diodes D8, D9 and a current-limiting resistor R8. The value of the voltage regulator diode D8 is greater than that of the voltage regulator diode D9, and the value of the voltage regulator diode D9 should not exceed the maximum operating voltage value of the digital control chip U1.

The digital trigger reference signal processing circuit comprises resistors R11, R12, a voltage regulator diode D13 and a capacitor C7;

The digital ignition trigger circuit comprises a resistor R7 and a diode D4;

The ignition mode switching circuit comprises a resistor R10 and a diode D5;

The flameout circuit comprises diodes D10, D14, a resistor R9, a voltage regulator diode D12 and a flameout switch S1; When the flameout circuit is in the analog trigger ignition phase, if the flameout switch S1 is closed, the analog ignition trigger signal C is grounded with the flameout switch S1 via the diode D14 to close the analog trigger ignition function. In the normal digital control phase, the GP5 port of the digital control chip U1 is detected to judge if the ignition signals are output.

The capacitor charging and discharging ignition circuit generates an A-AC single-wave P at the end 1 of the charging coil L1 and generates B-AC dual-waves P1 and P2 at the end 2 of the charging coil L1 through the rectification of the diodes D1, D6, and D11 when the engine magneto is running one cycle.

In terms of the sensing time sequence, the B-AC dual-wave P1 comes first, then A-AC single-wave P comes, and finally B-AC dual-wave P2 comes;

B-AC dual-waves P1 and P2 charge the SCM power supply circuit via the diode D7; when B-AC dual-wave P1 comes, P1 triggers turn-on of the thyristor Q1 through the resistor R6 and diode D3, which achieves the function of analog trigger ignition when digital control chip U1 is not working normally. When A-AC single-wave P comes, the charging capacitor C1 is charged and stored by the diode D1; at the same time, A-AC single-wave P charges the capacitor C2 through the resistor R2, and triggers the turn-on of the thyristor Q2 when reaching a predetermined voltage value. At this time, the analog ignition trigger function is turned off. During fallback of the A-AC single-wave P, the capacitor C2 is gradually discharged through the resistor R4 and diode D2; when the B-AC dual-wave P2 comes, the thyristor Q2 continues to be in the On state under P2 forward voltage and energy storage of capacitor C2, to prevent false triggering of AC dual-wave P2, and the thyristor Q2 is completely turned off until completion of the discharging of the capacitor C2 and fallback of the AC dual-wave P2, to ensure that only the B-AC dual-wave P1 is triggered.

After the SCM power supply is stabilized, it is required to start switching. Before switching, ensure that the analog trigger ignition mode is continued for N times and the engine running cycle value is recorded. Specifically, a digital control chip U1 controls the GP0 port to output low level first, and GP4 port is configured as an input state, and the monitoring module starts to monitor analog ignition trigger signal C. When detecting the P1' wave of analog ignition trigger waveform C, a high level is detected at the GP4 port of the digital control chip U1, then a 16-bit timer T1 is turned on to start timing until the P1' wave of the next analog ignition trigger waveform C comes, then the timer is turned off and then turned on again, and recycled, to record the accumulated number of running turns S. When the number of running turns S reaches the set value N, record the N-th running cycle of engine Tn; at the same time, the SCM outputs a high level to the GP0 port, and the thyristor Q2 is turned on through the ignition mode switching circuit, to achieve the turn-off of the analog trigger ignition function; and then the GP4 port is configured as an output state to output low level. At this time, the analog and digital triggering functions are turned off simultaneously, waiting for the charging of the charging capacitor C1;

When the analog trigger ignition function is turned off, the timer starts timing. When the value of the timer is Tn/2, the signal acquisition starts; specifically, by configuring the GP2 port as external rising edge-triggered interrupt functions, the trigger reference waveform D is detected. The P1" of the trigger reference waveform D is acquired and the ignition delay value is calculated by checking the table according to the recorded running cycle of the engine that runs S+1 times. The SCM passes through the GP4 port and outputs digital ignition signals via the resistor R7 and the diode D4, to achieve the switching from the analog trigger ignition started by the engine to the digital ignition control under normal operation. The flow block diagram of the switching process is shown in FIG. 5. The diodes D3, D4 have the functions of isolating the analog trigger ignition signals and the digital ignition signals.

Apparently, the embodiments described herein are only a part rather than the whole of embodiments of the present invention. All other embodiments obtained by those of ordinary skill in the art based on the embodiments of the present invention without creative work shall fall within the scope of protection of the present invention.

The invention claimed is:

1. The gasoline engine ignition method with analog and digital complementary control, comprising: performing an analog ignition by an analog trigger circuit, and starting to acquire digital trigger reference signals and connecting to a digital trigger circuit when the SCM power supply is stabilized and the SCM cuts off the analog trigger circuit, and then switching to digital signals to trigger ignition, wherein continuing N times of analog trigger ignitions when the SCM power supply is stabilized, and recording the accumulated number of running turns of the engine and the N-th running cycle of engine Tn; cutting off the analog trigger circuit when the number of running turns is equal to the preset number of turns N, and starting to acquire digital trigger reference signals and connecting to the digital trigger circuit after the time of Tn/M.

2. An ignition system of gasoline engine with analog and digital complementary control, comprising: a SCM; a capacitor charging circuit for charging a charging capacitor, comprising a charging coil L1, a diode D1, and a charging capacitor C1; a thyristor Q1, used to control the charging capacitor C1 for charging and discharging; a digital trigger reference signal processing circuit, connected to the SCM, for processing a voltage signal generated by the charging coil L1 to form a digital trigger reference signal; an analog trigger circuit, connected to the thyristor Q1, for controlling a discharge timing of the charging capacitor C1; a digital trigger circuit, connected to the SCM and the thyristor Q1, for controlling the discharge timing of the charging capacitor C1; an ignition mode switching circuit, connected to the SCM and the analog trigger circuit, for cutting off the analog trigger circuit; a monitoring module, disposed in the SCM and connected to the analog trigger circuit, for monitoring the analog ignition signal of the analog trigger circuit and recording the engine running cycle value Tn at the last trigger when the SCM power supply is stabilized; a signal acquisition module, disposed in the SCM and connected to the digital trigger reference signal processing circuit, for determining when to acquire the digital trigger reference signal according to the engine running cycle value Tn recorded by the monitoring module.

3. The ignition system of gasoline engine with analog and digital complementary control according to claim 2, wherein an isolating circuit is provided between the analog trigger circuit and the digital trigger circuit for isolating the analog trigger ignition signal from the digital trigger ignition signal.

4. The ignition system of gasoline engine with analog and digital complementary control according to claim 2, further comprising a flameout circuit, connected to the SCM and the analog trigger circuit, for cutting off the analog trigger circuit and the digital trigger circuit.

5. The ignition system of gasoline engine with analog and digital complementary control according to claim 2, further comprising a power supply circuit connected to the SCM for receiving AC waveforms generated by the charging coil L1 and providing power source for SCM.

* * * * *